US011538444B2

(12) United States Patent
Kasubuchi et al.

(10) Patent No.: US 11,538,444 B2
(45) Date of Patent: Dec. 27, 2022

(54) KEYBOARD APPARATUS AND KEY GUIDING METHOD

(71) Applicant: Roland Corporation, Shizuoka (JP)

(72) Inventors: Masaki Kasubuchi, Shizuoka (JP); Mutsuo Sawada, Shizuoka (JP); Hitoshi Sato, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/509,052

(22) Filed: Oct. 24, 2021

(65) Prior Publication Data

US 2022/0208150 A1 Jun. 30, 2022

(30) Foreign Application Priority Data

Dec. 25, 2020 (JP) ..... JP2020-217520

(51) Int. Cl.
*G10D 3/12* (2020.01)
*G10C 3/12* (2006.01)

(52) U.S. Cl.
CPC ..... *G10C 3/12* (2013.01)

(58) Field of Classification Search
CPC ..... G10C 3/12; G10H 1/346; G10D 3/00
See application file for complete search history.

(56) References Cited

U.S. PATENT DOCUMENTS 5,070,218 A * 12/1991 Katsuta ..... H01H 13/70 84/434
5,834,668 A 11/1998 Kumano et al.

FOREIGN PATENT DOCUMENTS

| | | |
|---|---|---|
| JP | H096329 | 1/1997 |
| JP | H09330084 | 12/1997 |
| JP | 2002006832 | 1/2002 |

* cited by examiner

*Primary Examiner* — Kimberly R Lockett
(74) *Attorney, Agent, or Firm* — JCIPRNET

(57) ABSTRACT

Provided is a keyboard apparatus including: a key, displaced about a key axis and having a cavity opening downward formed therein; and a guide member, having a guide inserted into the cavity of the key and guiding displacement of the key by contact between a guided surface of the key and the guide. The key includes a stopper formed within the cavity. The stopper includes a base connected to the key and extending downward, and a hook formed on a lower end side of the base and displaced in a position vertically side by side with the key axis. The guide includes a recess formed on a rear surface of the guide, and the hook is inserted into the recess. The hook is formed in a position overlapping the guided surface or a position vertically side by side with the guided surface in a left-right view of the key.

20 Claims, 4 Drawing Sheets

KEYBOARD APPARATUS AND KEY GUIDING METHOD

CROSS-REFERENCE TO RELATED APPLICATIONS

This application claims the priority benefit of Japan Application No. 2020-217520, filed on Dec. 25, 2020. The entirety of the above-mentioned patent application is hereby incorporated by reference herein and made a part of this specification.

BACKGROUND

Technical Field

The disclosure relates to a keyboard apparatus, particularly to a keyboard apparatus and a key guiding method in which the degree of design freedom can be improved.

Related Art

There are known a technique of guiding displacement (swing or rotation) of a key of a keyboard apparatus by a guide member and a technique of restricting the key from falling off a key shaft by a stopper when the key is pressed. For example, Patent Document 1 describes a technique of guiding displacement of a key by a pair of guide members (key guides 14a and 14b) disposed apart from each other in a front-rear direction. Patent Document 2 describes a technique of restricting a key from falling off a key shaft (rotation support 22) when the key is pressed by a stopper (upper piece 133 of an elastic piece 13) that presses the key against the key shaft.

PATENT DOCUMENTS

Patent Document 1: Japanese Laid-Open No. H09-006329 (for example, in paragraph 0044 and FIG. 1)

Patent Document 2: Japanese Laid-Open No. H09-330084 (for example, in paragraph 0026 and FIG. 3)

In the related art, the guide member is disposed on the front side (performer side) of the key with respect to the key shaft, and the stopper is disposed on the rear side of the key with respect to the key shaft. Therefore, in the case of a keyboard apparatus in which the guide member and the stopper are both provided, in regions on the front side and the rear side with respect to the key shaft, limitations are likely to be imposed on arrangement space of other members. Therefore, there is a problem that the degree of design freedom of the keyboard apparatus is reduced.

The disclosure provides a keyboard apparatus and a key guiding method in which the degree of design freedom can be improved.

SUMMARY

A keyboard apparatus of the disclosure includes: a key, displaced about a key axis and having a cavity opening downward formed therein; and a guide member, having a guide inserted into the cavity of the key and guiding displacement of the key by contact between a guided surface of the key and the guide. The key includes a stopper formed within the cavity. The stopper includes a base connected to the key and extending downward, and a hook formed on a lower end side of the base and displaced in a position vertically side by side with the key axis. The guide includes a recess formed on a rear surface of the guide, and the hook is inserted into the recess. The hook is formed in a position overlapping the guided surface or a position vertically side by side with the guided surface in a left-right view of the key.

A key guiding method of the disclosure is adapted for a keyboard apparatus. The keyboard apparatus includes: a key, displaced about a key axis and having a cavity opening downward formed therein; and a guide member, having a guide inserted into the cavity of the key and guiding displacement of the key by contact between a guided surface of the key and the guide. The key includes a stopper formed within the cavity. The stopper includes a base connected to the key and extending downward, and a hook formed on a lower end side of the base and displaced in a position vertically side by side with the key axis. The guide includes a recess formed on a rear surface of the guide, and the hook is inserted into the recess. The displacement of the key is guided by the guided surface formed in a position overlapping the hook or a position vertically side by side with the hook in a left-right view of the key.

DESCRIPTION OF THE EMBODIMENTS

Figure 1:
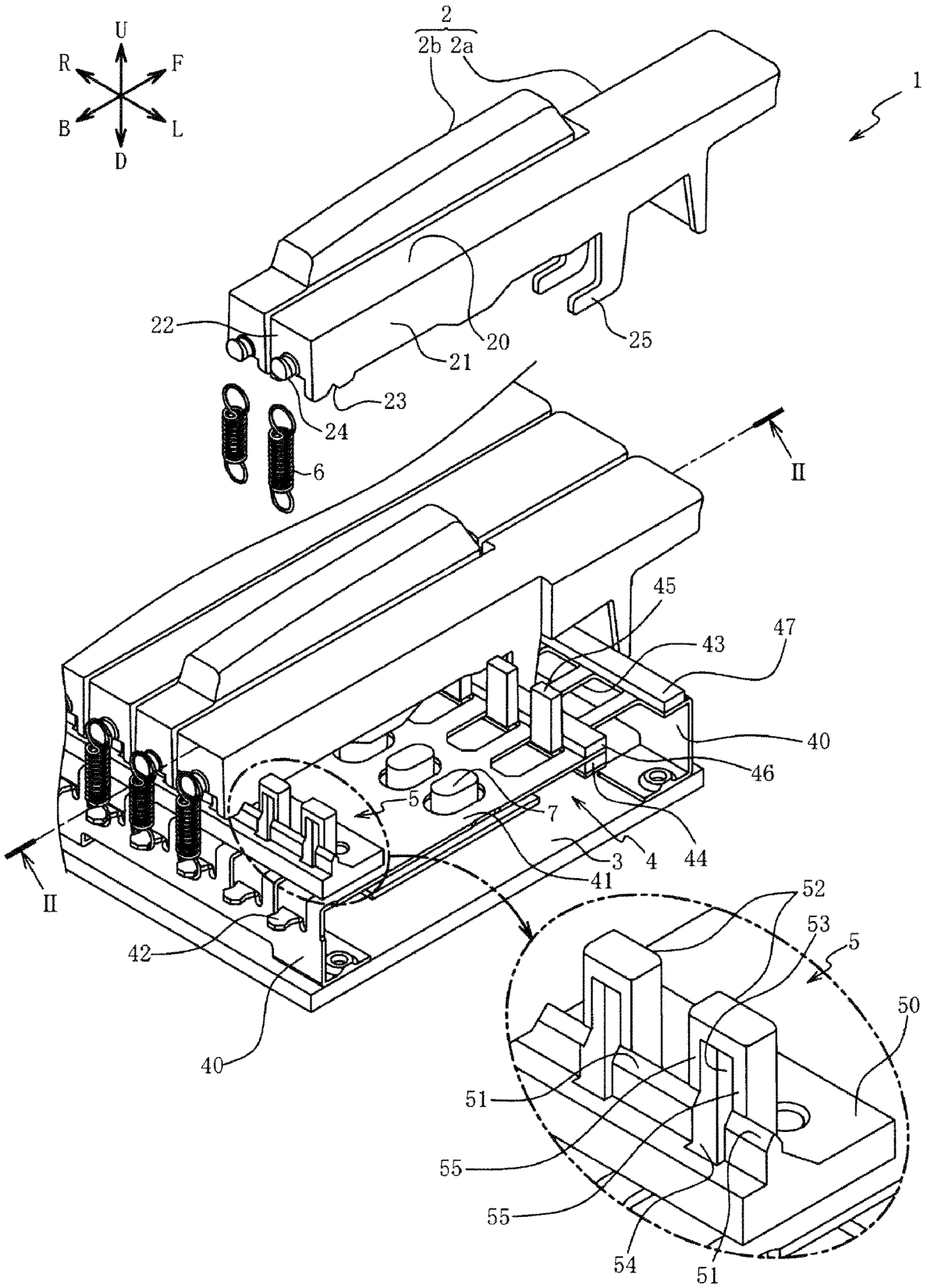
FIG. 1 is a perspective view of a keyboard apparatus according to one embodiment.

Hereinafter, embodiments are described with reference to the accompanying drawings. First, an overall configuration of a keyboard apparatus 1 is described with reference to FIG. 1. FIG. 1 is a perspective view of the keyboard apparatus 1 according to one embodiment. The arrows U-D, F-B, and L-R in FIG. 1 respectively indicate vertical direction, front-rear direction, and left-right direction of the keyboard apparatus 1, and the same applies to the following figures.

As shown in FIG. 1, the keyboard apparatus 1 is configured as a keyboard instrument (synthesizer) including multiple keys 2. The keys 2 include multiple white keys 2*a* for playing natural notes and multiple black keys 2*b* for playing derived notes. These white keys 2*a* and black keys 2*b* are provided side by side in the left-right direction (direction indicated by the arrows L-R) (scale direction).

The keys 2 include an upper plate 20 in which an upper surface (surface on the arrow U side) constitutes a key pressing surface pressed down by a performer. A pair of side plates 21 extend downward (toward the arrow D side) from both left and right ends of the upper plate 20 (see FIG. 3 for the point that the side plate 21 is provided in a left-and-right pair). Rear end portions (ends on the arrow B side) of the upper plate 20 and the side plate 21 are connected by a rear plate 22. The upper plate 20, the side plate 21, and the rear plate 22 are each formed in a plate shape using a resin material. In the keys 2, a cavity S opening downward is formed (see FIG. 2 and FIG. 3). The cavity S is a portion for allowing a later-described guide 52 (see FIG. 1) to be inserted thereinto.

In the keyboard apparatus 1, a bottom plate 3 and a chassis 4 for supporting the keys 2 are provided. The bottom plate 3 is formed in a plate shape using a synthetic resin, a steel plate, or the like, and the chassis 4 is fixed to an upper surface of the bottom plate 3 extending in the left-right direction. The chassis 4 includes a pair of legs 40 separated by a predetermined distance in the front-rear direction (direction indicated by the arrows F-B), and a support 41 connecting upper ends of the pair of legs 40 in the front-rear direction.

Each part (the leg 40 and the support 41) of the chassis 4 is formed in a plate shape using a synthetic resin, a steel plate, or the like. The chassis 4 is formed in a horizontal U-shape (C-shape) having a space between the support 41 and the bottom plate 3 in a left-right view. A guide member 5 guiding displacement of the keys 2 while supporting the keys 2 in a displaceable manner is fixed to an upper surface of the support 41.

The guide member 5 includes a base part 50 fixed to the chassis 4 (see the enlarged portion in FIG. 1). The base part 50 is formed in a plate shape extending in the left-right direction, and a key shaft 51 protrudes upward from an upper surface of the base part 50. An upper end of the key shaft 51 is formed in a tapered shape (mountain shape) tapering approaching the top. The keys 2 are supported by the key shaft 51.

A notch 23 (depression) having a mountain shape is formed on a lower surface of the side plate 21 of the keys 2, and the notch 23 is hooked (mounted) on the key shaft 51. Accordingly, the keys 2 are supported in a displaceable (swingable or rotatable) manner about the key shaft 51.

A convex part 24 having a substantially columnar shape protrudes rearward from the rear plate 22 of the keys 2. A hook on one end side of a coil spring 6 (elastic body) is hooked to the convex part 24. A hook on the other end side of the coil spring 6 is hooked to a protruding piece 42 of the chassis 4.

The protruding piece 42 protrudes rearward from a rear surface of the leg 40 of the chassis 4. Since the protruding piece 42 and the convex part 24 of the keys 2 are connected by the coil spring 6, when the keys 2 are pressed and displaced about the key shaft 51 (see FIG. 4), the performer is given a key pressing feel due to an elastic force of the coil spring 6.

On the other hand, when the keys 2 are released after being pressed, the keys 2 are displaced about the key shaft 51 by the elastic force of the coil spring 6 and return to an initial position. The displacement of the keys 2 toward the initial position is stopped by a key release stopper 25. The key release stopper 25 bends rearward while extending downward from a lower surface of the keys 2. In the support 41 of the chassis 4, an insertion hole 43 into which the key release stopper 25 is inserted is formed. A buffer material 44 is fixed to a lower surface (an edge of the insertion hole 43) of the support 41, and the displacement of the keys 2 during key releasing is restricted by contact between the buffer material 44 and a bent portion of the key release stopper 25.

Figure 2:
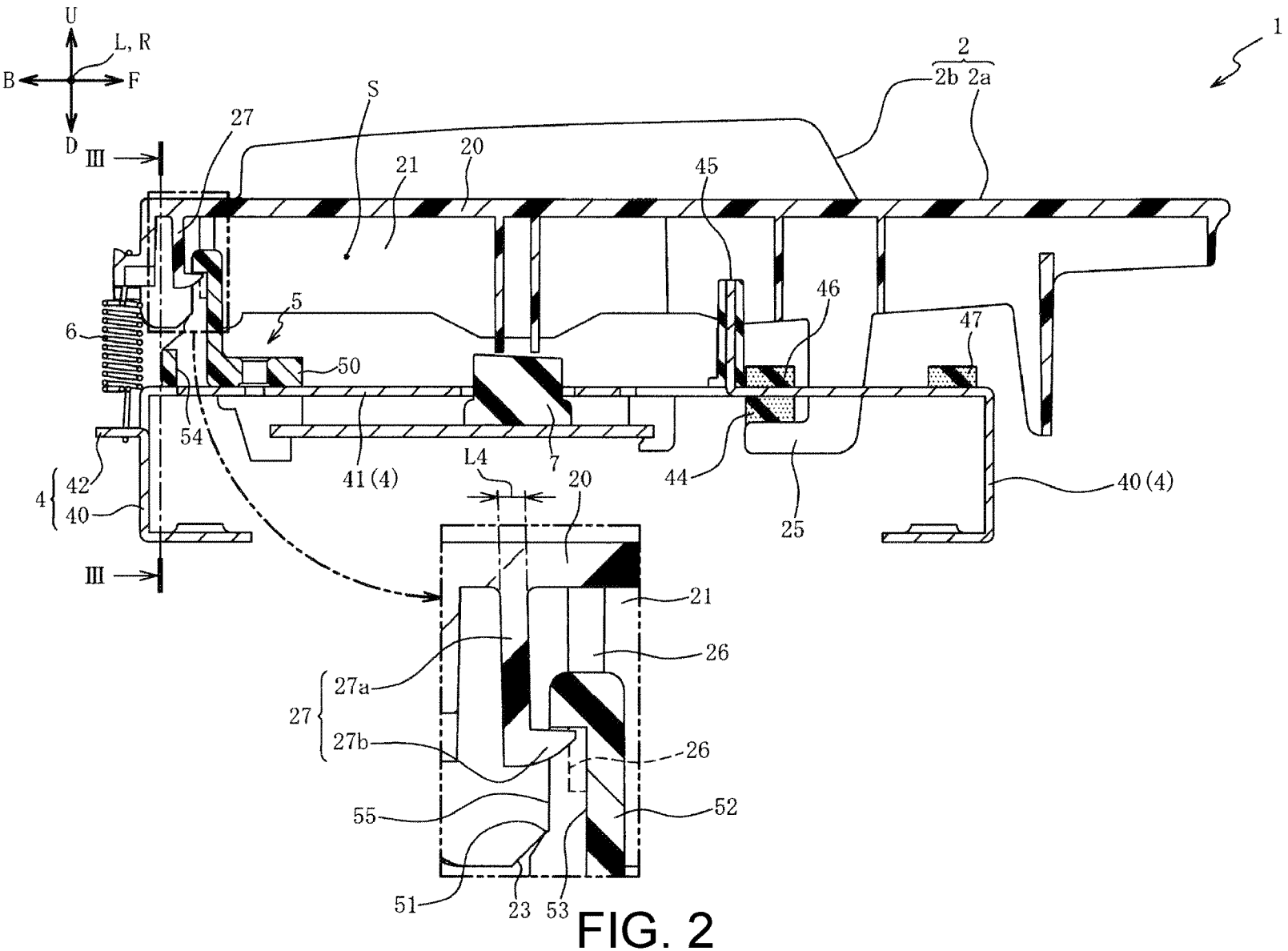
FIG. 2 is a cross-sectional view of the keyboard apparatus taken on line II-II of FIG. 1.
Figure 3:
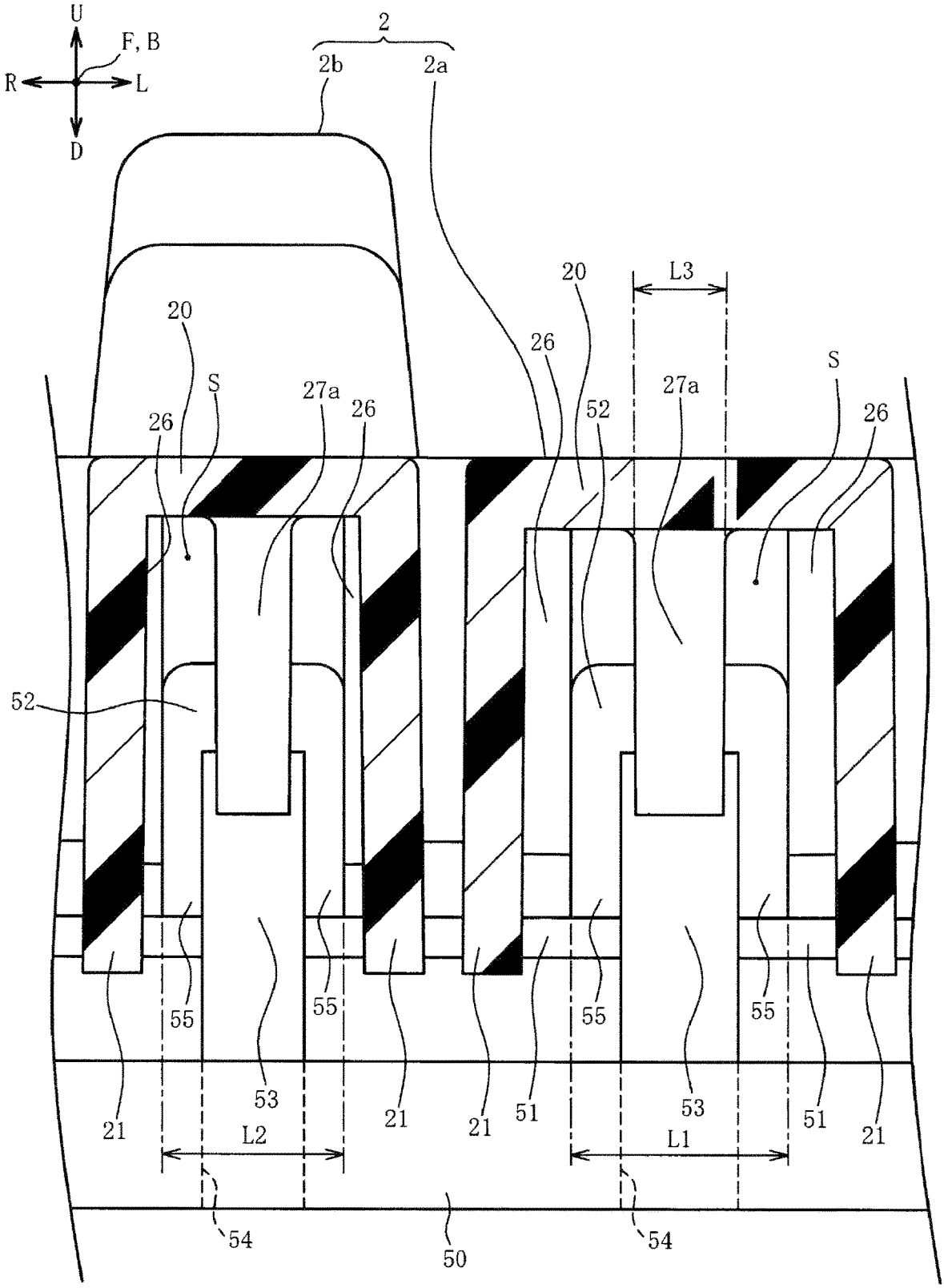
FIG. 3 is a partially enlarged cross-sectional view of the keyboard apparatus taken on line III-III of FIG. 2.
Figure 4:
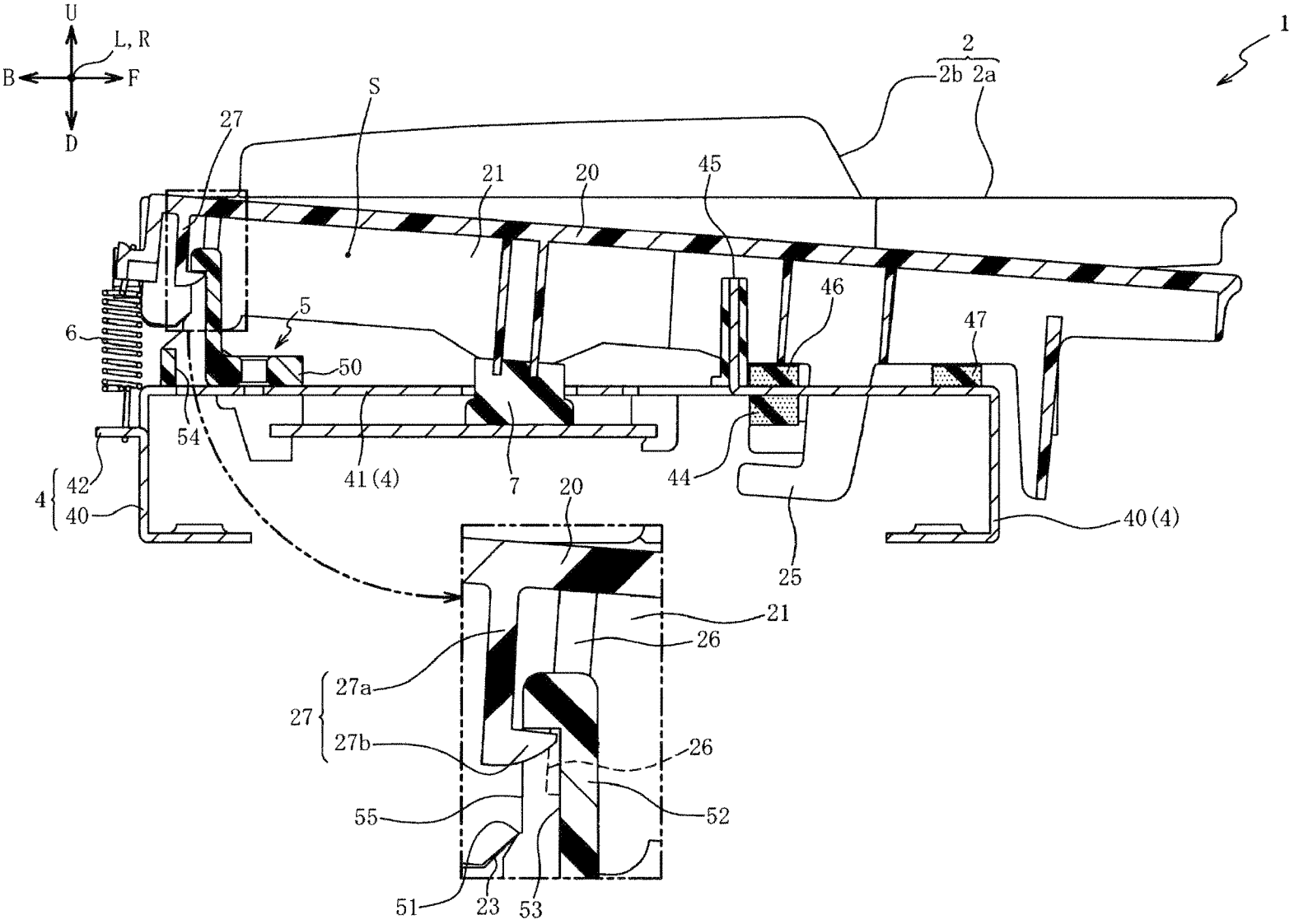
FIG. 4 is a cross-sectional view of the keyboard apparatus, showing a state in which a white key is pressed from the state of FIG. 2.

Next, a detailed configuration of the keyboard apparatus 1 is described with reference to FIG. 2 to FIG. 4, and also with reference to FIG. 1 as necessary. FIG. 2 is a cross-sectional view of the keyboard apparatus 1 taken on line II-II of FIG. 1. FIG. 3 is a partially enlarged cross-sectional view of the keyboard apparatus 1 taken on line III-III of FIG. 2. FIG. 4 is a cross-sectional view of the keyboard apparatus 1, showing a state in which the keys 2 are pressed from the state of FIG. 2. In the enlarged portions in FIG. 2 and FIG. 4, the position indicated by reference numeral 51 is the top of the key shaft 51 (see FIG. 1), that is, the position of an axis of swing (rotation) of the keys 2. In FIG. 2 and FIG. 4, illustration of the bottom plate 3 is omitted; in FIG. 3, illustration of the chassis 4 is omitted.

As shown in FIG. 2 and FIG. 3, the guide 52 of the guide member 5 is a protrusion having a substantially rectangular parallelepiped shape protruding upward above the key shaft 51, and is inserted into the cavity S of the keys 2 described above. A protrusion 26 protrudes toward a side surface of the guide 52 from an inner surface of each of the left-and-right pair of side plates 21. Since a distance between the left-and-right pair of protrusions 26 is formed to be substantially the same as a dimension of the guide 52 in the left-right direction, the displacement of the keys 2 in the left-right direction is restricted by contact between the protrusion 26 and the guide 52. Therefore, as shown in FIG. 2 and FIG. 4, when the keys 2 are pressed and displaced about the key shaft 51, the displacement of the keys 2 can be guided by the contact (sliding) between the protrusion 26 and the guide 52.

As shown in FIG. 3, a dimension L1 in the left-right direction of the guide 52 that guides displacement of the white key 2*a* is formed larger than a dimension L2 in the left-right direction of the guide 52 that guides displacement of the black key 2*b*. As a result, the distance between the pair of protrusions 26 of the white key 2*a* is also formed greater than the distance between the pair of protrusions 26 of the black key 2*b*. Therefore, the black key 2*b* is configured unable to be attached to the guide 52 that guides the displacement of the white key 2*a*. Accordingly, since the black key 2*b* can be prevented from being assembled in a wrong position, workability in assembly of the keys 2 can be improved.

By forming the dimension L1 in the left-right direction of the guide 52 that guides the white key 2*a* to be large (securing a wide guide width), a good playing feel can be given when the white key 2*a* is pressed. That is, as shown in FIG. 1, since the white key 2*a* includes a narrow part (portion adjacent to the black key 2*b*) on the key shaft 51 side and a wide part (portion on the front side of the black key 2*b*) connected to a front end of the narrow part and having a larger dimension in the left-right direction than the narrow part, when the wide part is pressed, rolling is likely to occur in the white key 2*a*. "Rolling" means that the white key 2*a* rotates (tilts) about an axis in the front-rear direction when pressed. In contrast, by securing a large dimension L1 in the left-right direction of the guide 52 that guides the white key 2*a*, rolling of the white key 2*a* can be easily controlled. Thus, a good playing feel can be given.

As shown in FIG. 2 and FIG. 4, the displacement of the keys 2 about the key shaft 51 is also guided by a front guide 45. The front guide 45 protrudes upward from the support 41 of the chassis 4 and is inserted between the pair of side plates 21. Accordingly, the displacement of the keys 2 in the left-right direction is restricted by contact (sliding) between the inner surfaces of the pair of side plates 21 and the front guide 45. Thus, the displacement of the keys 2 about the key shaft 51 can be guided by the front guide 45.

Since the front guide 45 is provided on the front side of the center in the front-rear direction of the keys 2, and the guide 52 is provided in the vicinity (position where the guide 52 overlaps the key shaft 51 in a left-right view) of the key shaft 51, the displacement of the keys 2 can be guided at two points separated from each other in the front-rear direction. Therefore, the displacement of the keys 2 about the key shaft 51 can be stably guided.

When the keys 2 are pressed, a switch 7 disposed below the keys 2 is pushed by the keys 2 (see FIG. 4). By on/off operations of the switch 7, key pressing information (note information) of the keys 2 is detected, and a musical tone signal is output to the outside based on a detection result.

Buffer materials 46 and 47 fixed to the support 41 of the chassis 4 are provided below the keys 2. Therefore, in a terminal position in key pressing where the switch 7 is pushed by the keys 2, the keys 2 are in contact with each of the switch 7 and the buffer materials 46 and 47. Since a pressure sensor (not shown) is provided between the buffer material 46 (or buffer material 47) and the support 41, the pressure when the buffer material 46 is pushed by the keys 2 is detected by the pressure sensor.

In the present embodiment, if it is detected by the switch 7 that the keys 2 are pressed to a predetermined depth (when the switch 7 is turned on), a normal musical tone is generated; on the other hand, if it is detected by the pressure sensor that the keys 2 are pressed deeper (stronger) (if a predetermined pressure is detected by the pressure sensor), an unusual musical tone is generated. The unusual musical tone is, for example, a musical tone having a different timbre, or a musical tone to which an effect (change in volume or vibrato) is added.

In such a configuration of generating different musical tones between when the keys 2 are pressed to the predetermined depth (strength) (first state) and when the keys 2 are pressed deeper (stronger) (second state), a performance is performed in which the keys 2 are further pushed from the terminal position in key pressing. Since the switch 7 and the buffer materials 46 and 47 that restrict the displacement of the keys 2 in the terminal position in key pressing are located on the front side of the key shaft 51, when the keys 2 are pressed by a force exceeding the elastic force of the coil spring 6, the keys 2 may rise up from the key shaft 51 with the switch 7 or the buffer materials 46 and 47 as a fulcrum. When the keys 2 rise up from the key shaft 51, a force pushing the switch 7 or the pressure sensor is accordingly weakened. Therefore, it is not possible to accurately detect (discriminate) between when the keys 2 are pressed to the predetermined depth and when the keys 2 are pressed deeper than the predetermined depth. Therefore, in the present embodiment, a configuration is adopted in which the rise of the keys 2 is restricted by a stopper 27.

As shown in FIG. 2 and FIG. 3, the stopper 27 includes a base 27*a* connected to a lower surface of the upper plate 20 of the keys 2 and a hook 27*b* (see the enlarged portion in FIG. 2) protruding forward from a lower end of the base 27*a*. The stopper 27 is integrally formed with the keys 2 using a resin material. The base 27*a* extends downward from a central portion of the upper plate 20 in the left-right direction (see FIG. 3), and is configured so that the base 27*a* and the guide 52 of the guide member 5 face each other in the front-rear direction.

A recess 53 having a groove shape extending vertically is formed on a rear surface of the guide 52, and the hook 27*b* of the stopper 27 is inserted into the recess 53. Accordingly, the rise of the keys 2 can be restricted by hooking the hook 27*b* and an upper end (upper end surface of the recess 53) of the recess 53 together. Accordingly, even in the case of generating different musical tones depending on the depth of key pressing of the keys 2 as described above, the keys 2 can be prevented from rising up from the key shaft 51 when the keys 2 are further pushed from the terminal position (state in FIG. 4) in key pressing. Since the depth (strength) to which the keys 2 are pressed can be accurately detected by the switch 7 or the pressure sensor, a good playing feel can be given to the performer.

In this way, by restricting the rise of the keys 2 by hooking the recess 53 formed in the guide member 5 and the hook 27*b* together, the guide member 5 is able to have a function of restricting the rise of the keys 2 and a function of guiding the displacement of the keys 2.

In this case, for example, it is also possible to form the protrusion 26 on the front side of the hook 27*b* and guide the displacement of the keys 2 by contact between the protrusion 26 and the guide 52. However, in such a configuration, since it is necessary to form the recess 53 for hooking the hook 27*b* and a guide surface for sliding the protrusion 26 in positions separated from each other in the front-rear direction (to secure a long side surface of the guide 52 in the front-rear direction), the guide 52 is increased in size.

In contrast, in the present embodiment, the protrusion 26 and the hook 27*b* are formed in positions overlapping each other in a left-right view. That is, since a tip surface (guided surface of the keys 2) of the protrusion 26 that contacts the side surface of the guide 52 is formed in a position overlapping (vertically side by side with) the hook 27*b* in a left-right view (see FIG. 2), the recess 53 for hooking the hook 27*b* and the guide surface for sliding the protrusion 26 can be formed in adjacent positions. Accordingly, since a dimension of the guide 52 in the front-rear direction can be reduced, the guide member 5 can be reduced in size. Since the hook 27*b* displaced in the position vertically side by side with the key shaft 51 is hooked to the guide member 5 reduced in size in this way, in a region on the front side or the rear side of the key shaft 51, imposition of limitations on arrangement space of other members can be suppressed. Therefore, the degree of design freedom of the keyboard apparatus 1 can be improved.

As shown in FIG. 2 and FIG. 4, when the keys 2 are pressed, the stopper 27 is also displaced about the key shaft 51. However, the hook 27*b* and the upper end of the recess 53 are preferably not in contact with each other in a stroke region in the middle of key pressing. The reason is that, if such contact occurs in the middle of key pressing, a good playing feel cannot be given, and the hook 27*b* is likely to be damaged by a load due to the contact with the recess 53.

On the other hand, in the terminal position (state in FIG. 4) in key pressing, the hook 27*b* preferably contacts the upper end of the recess 53, or a very small gap is preferably formed between the hook 27*b* and the upper end of the recess 53. The reason is that, if a large gap is formed between the hook 27*b* and the upper end of the recess 53 in the terminal position in key pressing, the hook 27*b* and the upper end of the recess 53 contact (collide with) each other when the keys 2 rise up from the key shaft 51, such that a good playing feel cannot be given to the performer.

In this case, as described above, since the hook 27*b* is also displaced about the key shaft 51 during key pressing, for example, if the hook 27*b* is disposed on the rear side of the key shaft 51, the hook 27*b* is displaced in an arc-shaped trajectory toward an obliquely front upper side during key pressing. With a configuration of performing displacement in this way, since a displacement amount of the hook 27*b* in the vertical direction increases, the hook 27*b* and the upper end of the recess 53 are likely to contact each other in the middle of key pressing.

Due to accumulation of dimensional tolerances or assembly errors of each part, the gap between the hook 27*b* and the recess 53 in the initial position before key pressing may vary. Therefore, in the case where the hook 27*b* is configured to be largely displaced up and down, in order to suppress the contact between the hook 27*b* and the upper end of the recess 53 in the middle of key pressing, it is necessary to ensure that the gap is large in the initial position before key pressing. As a result, since the gap is also likely to be formed large in the terminal position in key pressing, when the keys 2 are further pressed from the terminal position in key pressing, the hook 27*b* and the upper end of the recess 53 contact (collide with) each other, and a good playing feel cannot be given to the performer.

In contrast, in the present embodiment, in the initial position before key pressing, the hook 27*b* and the top of the key shaft 51 are formed in positions vertically side by side in a left-right view. That is, since the hook 27*b* is configured to be displaced in a position vertically side by side with the key shaft 51 in a left-right view from the initial position before key pressing until the terminal position, the displacement amount of the hook 27*b* in the vertical direction can be reduced as compared with the case where the hook 27*b* is disposed on the rear side of the key shaft 51. Therefore, even if the gap between the hook 27*b* and the upper end of the recess 53 is reduced in the initial position before key pressing, the hook 27*b* can be prevented from contacting the upper end of the recess 53 in the middle of key pressing. In addition, since the gap between the hook 27*b* and the upper end of the recess 53 can also be reduced in the terminal position in key pressing, even if the keys 2 are further pressed from the terminal position in key pressing and the hook 27*b* and the upper end of the recess 53 contact (collide with) each other, deterioration of the playing feel due to the contact can be suppressed.

Here, since the white key 2*a* is formed longer on the front side than the black key 2*b*, during playing of the white key 2*a*, key pressing often occurs on the front side away from the switch 7 (buffer materials 46 and 47) as compared with playing of the black key 2*b*. If a position (force point) where key pressing occurs is away from the switch 7 (fulcrum), when the keys 2 rise up from the key shaft 51 with the switch 7 as the fulcrum, a load acting on a contact portion (action point) between the hook 27*b* and the upper end of the recess 53 increases. Then, this load acts on the base 27*a* of the stopper 27. That is, the load acting on the base 27*a* of the stopper 27 of the white key 2*a* during key pressing is likely to be larger than that in the black key 2*b*.

In contrast, in the present embodiment, as described above, since the dimension L1 (see FIG. 3) in the left-right direction of the guide 52 that guides the white key 2*a* is ensured to be large, a dimension L3 in the left-right direction of the base 27*a* (hook 27*b*) of the stopper 27 of the white key 2*a* can accordingly be formed larger than that of the base 27*a* (hook 27*b*) of the black key 2*b*. Accordingly, rigidity of the stopper 27 (base 27*a*) provided in the white key 2*a* can be ensured. Thus, even if the hook 27*b* contacts the upper end of the recess 53 when the white key 2*a* is pressed, the stopper 27 can be prevented from being damaged.

In this way, in the present embodiment, the hook 27*b* is hooked to the recess 53 formed in the guide 52. However, for example, if the purpose is simply to hook the hook 27*b*, a configuration may be employed in which a hole (not in a groove shape, but a depression surrounding the hook 27*b*) is formed on the rear surface of the guide 52. In contrast, in the present embodiment, the recess 53 is formed in a groove shape extending vertically, and the through hole 54 connected to the recess 53 is formed in the guide member 5. The reason is to prevent an undercut from occurring in the guide 52.

That is, as shown in FIG. 1, the guide 52 is provided for each of multiple keys 2. The multiple guides 52 are integrally molded together with the base part 50 and the key shaft 51 using a resin material, and the number of parts can be reduced. The integral molding is performed by an upper mold and a lower mold that sandwich the guide member 5 from above and below. However, for example, in a configuration in which the through hole 54 shown in the enlarged portion in FIG. 1 is not formed, since the recess 53 becomes an undercut, a slide core for forming the recess 53 is required in addition to the upper and lower molds. Therefore, the mold for molding the guide member 5 becomes complex.

In contrast, in the present embodiment, the through hole 54 is formed vertically penetrating the base part 50 and the key shaft 51 and connected to the recess 53. A dimension of the through hole 54 in the left-right direction is the same as a dimension of the recess 53 in the left-right direction (see FIG. 3), and a dimension of the through hole 54 in the front-rear direction is formed larger than a dimension of the recess 53 in the front-rear direction (see FIG. 2). Since the through hole 54 extends vertically along the depression of the recess 53 (so as not to cause a step), the slide core for forming the recess 53 and the through hole 54 is unneeded (the recess 53 and the through hole 54 can be formed by forming a convex part corresponding to the recess 53 and the through hole 54 in the lower mold). Therefore, the cost of the mold for molding the guide member 5 can be reduced.

Since the recess 53 is formed in a groove shape extending vertically, a pair of sidewalls 55 extending vertically are formed on both the left and right sides of the recess 53. Since the sidewalls 55 extending vertically are utilized to guide the displacement of the keys 2 (protrusion 26), for example, as compared with a configuration in which the pair of sidewalls 55 is omitted, a wider guide surface guiding the displacement of the keys 2 can be secured. Therefore, the displacement of the keys 2 can be stably guided.

Here, a method of attaching the keys 2 to and detaching them from the guide member 5 is described with reference to FIG. 2. When the keys 2 are assembled onto the guide member 5, while the guide 52 is inserted between the pair of side plates 21 (protrusions 26) of the keys 2, the notch 23 is fitted so as to slid on the top of the key shaft 51 from the rear side (in the direction indicated by the arrow F) of the key shaft 51.

Since the rear surface (region where the recess 53 is not formed) of the guide 52 extends upward from the top of the key shaft 51, and the hook 27*b* protrudes further forward than the top of the notch 23, during a period during which the notch 23 is slid on the key shaft 51, the hook 27*b* contacts the rear surface (surface above the recess 53) of the guide 52. At the time of this contact, the base 27*a* of the stopper 27 is in a state of being bent (elastically deformed) rearward. When the tops of the notch 23 and the key shaft 51 substantially coincide with each other, the hook 27*b* is inserted into the recess 53, and the base 27*a* that was elastically deformed returns to the original state. Accordingly, the assembly of the keys 2 onto the guide member 5 is completed.

On the other hand, when the keys 2 are removed from the guide member 5, the keys 2 are pushed rearward (toward the arrow B side), and the notch 23 is slid along the top of the key shaft 51. At this time, since the keys 2 are displaced upward due to sliding of the notch 23 along the inclination of the key shaft 51, the hook 27*b* and the upper end of the recess 53 contact each other. At the time of this contact, the base 27*a* of the stopper 27 is also in an elastically deformed state. Then, when the hook 27*b* is removed from the recess 53, the base 27*a* that was elastically deformed returns to the original state.

In this way, in the present embodiment, the keys 2 can be attached to and detached from the guide member 5 by utilizing elastic deformation of the base 27*a* of the stopper 27. Therefore, in order to facilitate such elastic deformation, a dimension L4 of the base 27*a* in the front-rear direction is formed smaller than the dimension L3 (see FIG. 3) of the base 27*a* in the left-right direction. Accordingly, the base 27*a* is easily elastically deformed, thus facilitating attachment and detachment of the keys 2 with respect to the guide member 5.

The disclosure has been described above on the basis of the embodiments. However, as can be easily understood, the disclosure is not limited in any way to the above embodiments, and various modifications or alterations may be made without departing from the spirit of the disclosure.

The above embodiments have described the case where the keyboard apparatus 1 is configured as a synthesizer. However, the disclosure is not limited thereto. The technical idea of the above embodiments is also applicable in other electronic musical instruments (for example, an electronic piano or an electronic organ). Therefore, for example, the configuration of the above embodiments may be applied to the keyboard apparatus 1 in which musical tones are generated only by on/off of the switch 7.

The above embodiments have described the case of detecting the first state in which the keys 2 are pressed to the predetermined depth and the second state in which the keys 2 are pressed deeper than the predetermined depth by two sensors (the switch 7 and the pressure sensor). However, the disclosure is not limited thereto. A configuration may be employed in which the first state and the second state are detected by one sensor or three or more sensors. For example, if the first state and the second state are detected by one sensor, different musical tones may be generated between when the predetermined pressure is detected by the pressure sensor and when a pressure higher than the predetermined pressure is detected by the pressure sensor.

The above embodiments have described the case of detecting two states, namely, the first state in which the keys 2 are pressed to the predetermined depth and the second state in which the keys 2 are pressed deeper than the predetermined depth. However, the disclosure is not limited thereto. For example, a configuration may be employed in which a third state in which deeper (stronger) key pressing than that in the second state and a fourth state in which deeper key pressing than that in the third state are detected, and different musical tones are generated according to these states.

The above embodiments have described the case where the protrusion 26 is formed on the inner surface of the side plate 21 of the keys 2, that is, the case where the tip surface of the protrusion 26 is the "guided surface of the keys 2." However, the disclosure is not limited thereto. For example, a configuration may be employed in which the protrusion 26 is omitted, and the inner surface of the side plate 21 is directly guided by the side surface of the guide 52. In this configuration, in the inner surface of the side plate 21, a portion (portion that contacts the side surface of the guide 52 in the initial position before key pressing) that slides with the side surface of the guide 52 during key pressing corresponds to the "guided surface of the keys 2."

The above embodiments have described the case where the hook 27*b* protrudes forward from the lower end side of the base 27*a* of the stopper 27. However, the disclosure is not limited thereto. For example, a configuration may be employed in which the hook 27*b* protrudes from the base 27*a* on both the left and right sides (or either of the left and right sides). In this case, a vertically extending depression (depression formed on the rear surface of the guide 52 and having a smaller dimension than the recess 53 in the left-right direction) through which the base 27*a* is able to pass may be formed to be connected to the upper end of the recess 53, and the hook 27*b* protruding in the left-right direction may be configured to be hooked to the upper end of the recess 53. According to this configuration, the stopper 27 (base 27*a*) and the guide 52 can be disposed closer to each other than in the above embodiments. Thus, imposition of limitations on arrangement space of other members can be effectively suppressed.

The above embodiments have described the case where, in the initial position before key pressing, the hook 27*b* and the key shaft 51 are formed in positions vertically side by side (the key axis and the hook 27*b* overlap in a vertical view). However, the disclosure is not limited thereto. For example, a configuration may be employed in which, in the initial position before key pressing or in the middle of key pressing, the hook 27*b* is located on the rear side of the top of the key shaft 51 (in the middle of key pressing before reaching the terminal position in key pressing, the hook 27*b* is displaced on the rear side of the top of the key shaft 51).

That is, at least in the terminal position in key pressing, if the hook 27*b* is formed in a position vertically side by side with the key shaft 51 (in a vertical view, the key axis and the hook 27*b* overlap), in the region on the front side or the rear side of the key shaft 51, imposition of limitations on arrangement space of other members can be suppressed. While the key shaft 51 of the above embodiments is formed intermittently in the left-right direction due to formation of the through hole 54, a virtual straight line connecting the tops of multiple key shafts 51 in the left-right direction is a "key axis (axis of swing)" of the keys 2. Therefore, in the above embodiments, while the hook 27*b* and the top of the key shaft 51 are not formed in positions vertically side by side, the hook 27*b* and the "key axis" are formed in positions vertically side by side.

The above embodiments have described the case where the base part 50, the key shaft 51, and the guide 52 of the guide member 5 are integrally formed (into one part). However, the disclosure is not limited thereto. For example, the key shaft 51 the guide 52 may be configured to be separate parts.

The above embodiments have described the case where the chassis 4 and the guide member 5 are separate parts. However, the disclosure is not limited thereto. For example, a part or the whole of the guide member 5 may be configured as a part of the chassis 4 (a part on the chassis 4 side). Therefore, for example, a configuration may be employed in which a guide (corresponding to the guide 52) protrudes upward as in the form of the front guide 45 shown in FIG. 2, and a protruding tip portion thereof is bent rearward to hook the hook 27*b*. In addition, for example, a configuration may be employed in which a portion corresponding to the key shaft 51 protrudes from the chassis 4. In these configurations, the base part 50 (for fixing the key shaft or the guide to the chassis) may be omitted if necessary.

The above embodiments have described the case where the recess 53 is a groove extending to the lower end of the guide member 5 (a configuration in which the through hole 54 connected to the recess 53 is formed), and the pair of sidewalls 55 are formed on both the left and right sides of the recess 53. However, the disclosure is not limited thereto. For example, a configuration may be employed in which the through hole 54 is omitted and the recess 53 is simply formed as a depression (hole), or the pair of sidewalls 55 are omitted. The recess 53 may be a through hole (which penetrates the guide 52 in the front-rear direction) in the shape of a vertically extending groove. That is, the configuration is not limited to the above-described forms if the guide 52 is provided with a depression or a convex part capable of hooking the hook 27*b*.

The above embodiments have described the case where the dimension of the through hole 54 in the left-right direction is the same as the dimension of the recess 53 in the left-right direction and the dimension of the through hole 54 in the front-rear direction is formed larger than the dimension of the recess 53 in the front-rear direction (with no step occurring in a boundary portion between the recess 53 and the through hole 54). However, the disclosure is not limited thereto. If the dimension of the through hole 54 in each of the left-right and front-rear directions is set equal to or larger than the dimension of the recess 53 in each of the left-right and front-rear directions, even if a step occurs in the boundary portion between the recess 53 and the through hole 54, the recess 53 and the through hole 54 can be formed by the lower mold (without needing a slide core).

The above embodiments have described the case where the dimension L1 in the left-right direction of the guide 52 that guides the white key 2*a* is formed larger than the dimension L2 in the left-right direction of the guide 52 that guides the black key 2*b*. However, the disclosure is not limited thereto. For example, a configuration may be employed in which the dimension L1 in the left-right direction of the guide 52 that guides the white key 2*a* is smaller than the dimension L2 in the left-right direction of the guide 52 that guides the black key 2*b*, or the dimensions L1 and L2 in the left-right direction are the same.

The above embodiments have omitted examples of the material of the buffer materials 44, 46 and 47. As the buffer materials 44, 46 and 47, a known material such as felt or urethane foam may be used.

What is claimed is:

1. A keyboard apparatus, comprising:

a key, displaced about a key axis and having a cavity opening downward formed therein; and a guide member, having a guide inserted into the cavity of the key and guiding displacement of the key by contact between a guided surface of the key and the guide, wherein the key comprises a stopper formed within the cavity, the stopper comprises a base connected to the key and extending downward, and a hook formed on a lower end side of the base and displaced in a position vertically side by side with the key axis, the guide comprises a recess formed on a rear surface of the guide, the hook being inserted into the recess, and the hook is formed in a position overlapping the guided surface or a position vertically side by side with the guided surface in a left-right view of the key.

2. The keyboard apparatus according to claim 1, wherein the recess is a groove extending to a lower end of the guide member.

3. The keyboard apparatus according to claim 2, wherein the guide comprises sidewalls formed in a pair with the recess interposed therebetween, and the displacement of the key is guided by side surfaces of the sidewalls.

4. The keyboard apparatus according to claim 2, wherein the guide member comprises a base part, a key shaft protruding upward from the base part to support the key and constituting the key axis, and the guide protruding upward above the key shaft, and the base part, the key shaft, and the guide are integrally formed of a resin material.

5. The keyboard apparatus according to claim 4, wherein the guide member further comprises a through hole vertically penetrating the base part and the key shaft and connected to the recess.

6. The keyboard apparatus according to claim 1, wherein the key comprises a white key and a black key, and a dimension of the guide in a left-right direction differs between the guide that guides displacement of the white key and the guide that guides displacement of the black key.

7. The keyboard apparatus according to claim 6, wherein the guide that guides the displacement of the white key has a larger dimension in the left-right direction than the guide that guides the displacement of the black key.

8. The keyboard apparatus according to claim 7, wherein the base of the stopper provided in the white key has a larger dimension in the left-right direction than the base of the stopper provided in the black key.

9. The keyboard apparatus according to claim 1, further comprising:

a sensor, detecting a first state in which the key is pressed to a predetermined depth and a second state in which the key is pressed deeper than in the first state, wherein different musical tones are generated between when the first state is detected and when the second state is detected by the sensor, and the hook and the recess are configured to hook together when the key is pressed to a depth greater than that of the second state.

10. The keyboard apparatus according to claim 1, wherein the hook and the key axis are formed in positions vertically side by side in an initial position before key pressing.

11. A key guiding method, adapted for a keyboard apparatus, the keyboard apparatus comprising a key displaced about a key axis and having a cavity opening downward formed therein, and a guide member having a guide inserted into the cavity of the key and guiding displacement of the key by contact between a guided surface of the key and the guide, wherein the key comprises a stopper formed within the cavity, the stopper comprises a base connected to the key and extending downward, and a hook formed on a lower end side of the base and displaced in a position vertically side by side with the key axis, the guide comprises a recess formed on a rear surface of the guide, the hook being inserted into the recess, and the displacement of the key is guided by the guided surface formed in a position overlapping the hook or a position vertically side by side with the hook in a left-right view of the key.

12. The key guiding method according to claim 11, wherein the recess is a groove extending to a lower end of the guide member.

13. The key guiding method according to claim 12, wherein the guide comprises sidewalls formed in a pair with the recess interposed therebetween, and the key guiding method comprises:

guiding the displacement of the key by side surfaces of the sidewalls.

14. The key guiding method according to claim 12, wherein the guide member comprises a base part, a key shaft protruding upward from the base part to support the key and constituting the key axis, and the guide protruding upward above the key shaft, and the base part, the key shaft, and the guide are integrally formed of a resin material.

15. The key guiding method according to claim 14, wherein the guide member further comprises a through hole vertically penetrating the base part and the key shaft and connected to the recess.

16. The key guiding method according to claim 11, wherein the key comprises a white key and a black key, and a dimension of the guide in a left-right direction differs between the guide that guides displacement of the white key and the guide that guides displacement of the black key.

17. The key guiding method according to claim 16, wherein the guide that guides the displacement of the white key has a larger dimension in the left-right direction than the guide that guides the displacement of the black key.

18. The key guiding method according to claim 17, wherein the base of the stopper provided in the white key has a larger dimension in the left-right direction than the base of the stopper provided in the black key.

19. The key guiding method according to claim 11, wherein the keyboard apparatus further comprises a sensor, detecting a first state in which the key is pressed to a predetermined depth and a second state in which the key is pressed deeper than in the first state, wherein different musical tones are generated between when the first state is detected and when the second state is detected by the sensor, and the hook and the recess are configured to hook together when the key is pressed to a depth greater than that of the second state.

20. The key guiding method according to claim 11, wherein the hook and the key axis are formed in positions vertically side by side in an initial position before key pressing.

* * * * *